US010366821B2

(12) United States Patent
Shinkai et al.

(10) Patent No.: US 10,366,821 B2
(45) Date of Patent: Jul. 30, 2019

(54) COMMON MODE NOISE FILTER

(71) Applicant: Panasonic Intellectual Property Management Co., Ltd., Osaka (JP)

(72) Inventors: Atsushi Shinkai, Fukui (JP); Kenji Ueno, Fukui (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 114 days.

(21) Appl. No.: 15/544,647

(22) PCT Filed: Jan. 12, 2016

(86) PCT No.: PCT/JP2016/000105
§ 371 (c)(1),
(2) Date: Jul. 19, 2017

(87) PCT Pub. No.: WO2016/132666
PCT Pub. Date: Aug. 25, 2016

(65) Prior Publication Data

US 2018/0286563 A1 Oct. 4, 2018

(30) Foreign Application Priority Data

Feb. 17, 2015 (JP) ..... 2015-028156

(51) Int. Cl.
*H01F 27/28* (2006.01)
*H01F 27/32* (2006.01)
*H01F 17/00* (2006.01)

(52) U.S. Cl.
CPC ..... *H01F 27/2804* (2013.01); *H01F 17/0013* (2013.01); *H01F 27/323* (2013.01);
(Continued)

(58) Field of Classification Search
CPC ..... H01F 27/2804; H01F 27/323
(Continued)

(56) References Cited

U.S. PATENT DOCUMENTS 3,348,182 A * 10/1967 Baker ..... H01F 27/2871 336/187
2003/0052766 A1 3/2003 Tomohiro et al.
2011/0050380 A1* 3/2011 Nakanishi ..... H01F 17/0013 336/200

FOREIGN PATENT DOCUMENTS

JP 2003-077727 A 3/2003
JP 2005-012072 A 1/2005
(Continued)

*Primary Examiner* — Tszfung J Chan
(74) *Attorney, Agent, or Firm* — McDermott Will & Emery LLP

(57) ABSTRACT

A common mode noise filter of the present disclosure includes: a first insulating layer; a second insulating layer formed under the first insulating layer; a first coil including a first coil conductor and a second coil conductor, the first coil conductor being electrically connected to the second coil conductor; a second coil including a third coil conductor and a fourth coil conductor, the third coil conductor being electrically connected to the fourth coil conductor; and a third coil including a fifth coil conductor and a sixth coil conductor, the fifth coil conductor being electrically connected to the sixth coil conductor. Further, the first coil conductor, the third coil conductor, and the fifth coil conductor are sequentially formed on the first insulating layer from the outer side. The sixth coil conductor, the fourth coil conductor, and the second coil conductor are sequentially formed on second insulating layer from the outer side.

5 Claims, 6 Drawing Sheets

(52) U.S. Cl.
CPC ..... *H01F 2017/0093* (2013.01); *H01F 2027/2809* (2013.01)

(58) Field of Classification Search
USPC ..... 336/200, 232
See application file for complete search history.

(56) References Cited

FOREIGN PATENT DOCUMENTS

| | | | | |
|---|---|---|---|---|
| JP | 2005012072 | A | * | 1/2005 |
| JP | 2006-294723 | A | | 10/2006 |
| JP | 2006294723 | A | * | 10/2006 |

* cited by examiner

COMMON MODE NOISE FILTER

RELATED APPLICATIONS

This application is the U.S. National Phase under 35 U.S.C. § 371 of International Application No. PCT/JP2016/000105, filed on Jan. 12, 2016, which in turn claims the benefit of Japanese Application No. 2015-028156, filed on Feb. 17, 2015, the disclosures of which are incorporated by reference herein.

TECHNICAL FIELD

The present disclosure relates to a compact, slim common mode noise filter for use in various electronic devices, including a digital device, an audiovisual device, and an information communication terminal.

BACKGROUND ART

As illustrated in FIG. 5, a conventional common mode noise filter includes a plurality of insulating layers 1 and three independent coils 2 to 4. Coil 2 includes coil conductors 2*a*, 2*b* electrically connected to each other. Coil 3 includes coil conductors 3*a*, 3*b* electrically connected to each other. Coil 4 includes coil conductors 4*a*, 4*b* electrically connected to each other. Coil conductor 2*a*, coil conductor 2*b*, coil conductor 3*a*, coil conductor 3*b*, coil conductor 4*a*, and coil conductor 4*b* are sequentially stacked from the bottom.

PTL 1 is known as a prior art document relating to the present disclosure, for example.

CITATION LIST

Patent Literature

PTL 1: Unexamined Japanese Patent Publication No. 2003-77727

SUMMARY OF THE INVENTION

An aspect of a common mode noise filter of the present disclosure includes: a first insulating layer; a second insulating layer formed under the first insulating layer; a first coil including a first coil conductor and a second coil conductor, the first coil conductor being electrically connected to the second coil conductor; a second coil including a third coil conductor and a fourth coil conductor, the third coil conductor being electrically connected to the fourth coil conductor; and a third coil including a fifth coil conductor and a sixth coil conductor, the fifth coil conductor being electrically connected to the sixth coil conductor. The first coil, the second coil, and the third coil are electrically independent of one another. The first coil conductor, the third coil conductor, and the fifth coil conductor are formed side by side on the first insulating layer in a spiral fashion such that the first coil conductor, the third coil conductor, and the fifth coil conductor are sequentially positioned from an outer side of the first insulating layer. The first coil conductor, the third coil conductor, and the fifth coil conductor have regions disposed in parallel to one another. The second coil conductor, the fourth coil conductor, and the sixth coil conductor are formed side by side on the second insulating layer such that the sixth coil conductor, the fourth coil conductor, and the second coil conductor are sequentially positioned from an outer side of the second insulating layer. The second coil conductor, the fourth coil conductor, and the sixth coil conductor have regions disposed in parallel to one another. The first coil conductor and the sixth coil conductor have regions overlapping each other as seen from a top view. The second coil conductor and the fifth coil conductor have regions overlapping each other as seen from a top view.

Another aspect of a common mode noise filter of the present disclosure includes: a first insulating layer; a second insulating layer formed under the first insulating layer; a first coil including a first coil conductor and a second coil conductor, the first coil conductor being electrically connected to the second coil conductor; a second coil including a third coil conductor and a fourth coil conductor, the third coil conductor being electrically connected to a fourth coil conductor; and a third coil including a fifth coil conductor and a sixth coil conductor, the fifth coil conductor being electrically connected to the sixth coil conductor. The first coil, the second coil, and the third coil are electrically independent of one another. The first coil conductor, the third coil conductor, and the fifth coil conductor are formed side by side on the first insulating layer in a spiral fashion such that the first coil conductor, the third coil conductor, and the fifth coil conductor are sequentially positioned from an outer side of the first insulating layer. The first coil conductor, the third coil conductor, and the fifth coil conductor have regions disposed in parallel to one another. The second coil conductor, the fourth coil conductor, and the sixth coil conductor are formed side by side on the second insulating layer such that the fourth coil conductor, the sixth coil conductor, and the second coil conductor are sequentially positioned from an outer side of the second insulating layer. The second coil conductor, the fourth coil conductor, and the sixth coil conductor have regions disposed in parallel to one another. The first coil conductor and the fourth coil conductor have regions overlapping each other as seen from a top view. The third coil conductor and the sixth coil conductor have regions overlapping each other as seen from a top view. The fifth coil conductor and the second coil conductor have regions overlapping each other as seen from a top view.

DESCRIPTION OF EMBODIMENTS

Prior to the explanation of some exemplary embodiments, a problem with the technique described in PTL 1 will be explained.

Figure 5:
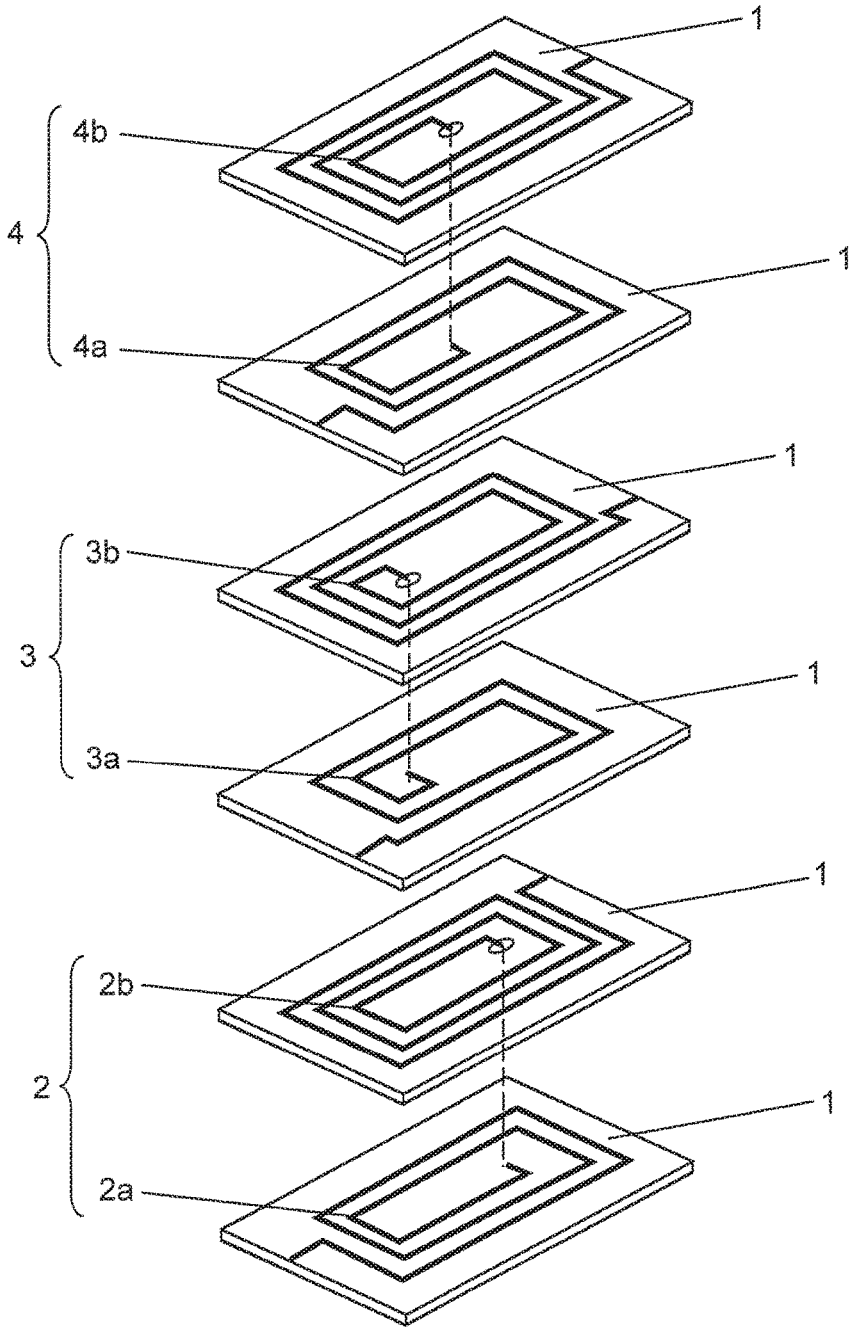
FIG. 5 PRIOR ART
FIG. 5 is an exploded perspective view of a conventional common mode noise filter.

In the conventional common mode noise filter that has been described with reference to FIG. 5, coil 3 is disposed between coil 2 and coil 4. This disposition increases the distance between coil 2 and coil 4, suppressing coil 2 and coil 4 from being magnetically coupled to each other. Coil 2 is disposed adjacent to coil 3 only at one location, and coil 3 is also disposed adjacent to coil 4 only at one location. Therefore, the magnetic couplings between coils 2 and 3 and between coils 3 and 4 are not so strong. This decreases the impedance of the common mode component, and as a result, lowers the capacity to eliminate common mode noise.

Figure 6:
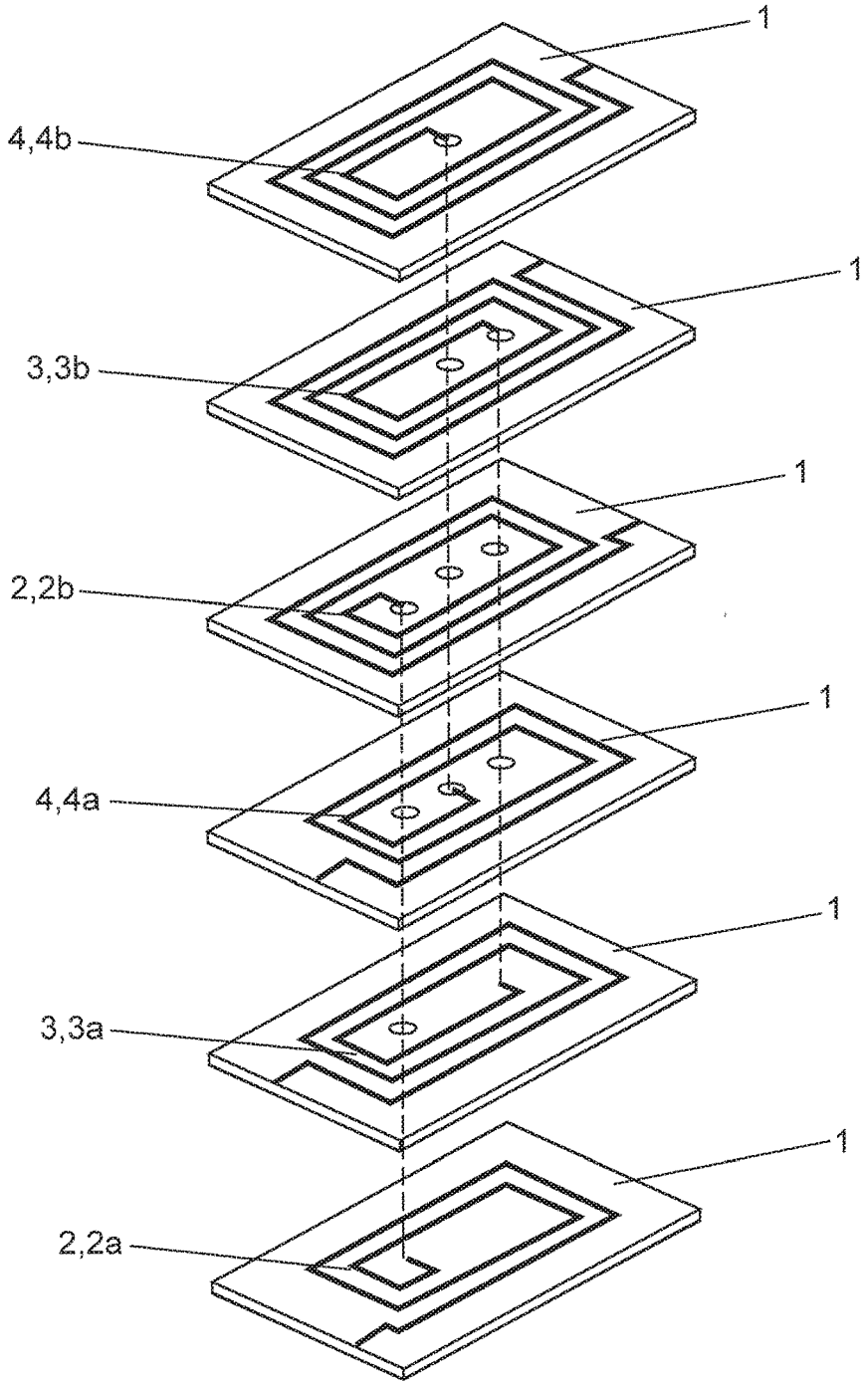
FIG. 6 is an exploded perspective view of another common mode noise filter.

Another common mode noise filter, as illustrated in FIG. 6, is conceivable. The common mode noise filter illustrated in FIG. 6 will be described below.

Coil conductor 2*a*, coil conductor 3*a*, coil conductor 4*a*, coil conductor 2*b*, coil conductor 3*b*, and coil conductor 4*b* are sequentially stacked from the bottom. Further, coil conductor 2*a* and coil conductor 2*b* constitute coil 2; coil conductor 3*a* and coil conductor 3*b* constitute coil 3; and coil conductor 4*a* and coil conductor 4*b* constitute coil 4.

In the common mode noise filter illustrated in FIG. 6, coil 2 is disposed adjacent to coil 3 at two locations, and coil 3 is also disposed adjacent to coil 4 at two locations. Therefore, the common mode noise filter illustrated in FIG. 6 provides a stronger magnetic coupling than the common mode noise filter illustrated in FIG. 5.

However, since coil 2 is disposed adjacent to coil 4 only at one location, the magnetic coupling at this location is weaker than the magnetic coupling at the adjacent location of coil 2 and coil 3 or the magnetic coupling at the adjacent location of coil 3 and coil 4. In short, in the common mode noise filter illustrated in FIG. 6, the magnetic coupling of coils 2, 3, and 4 may be imbalanced.

First Exemplary Embodiment

A common mode noise filter in a first exemplary embodiment will be described below with reference to FIG. 1.

Figure 1:
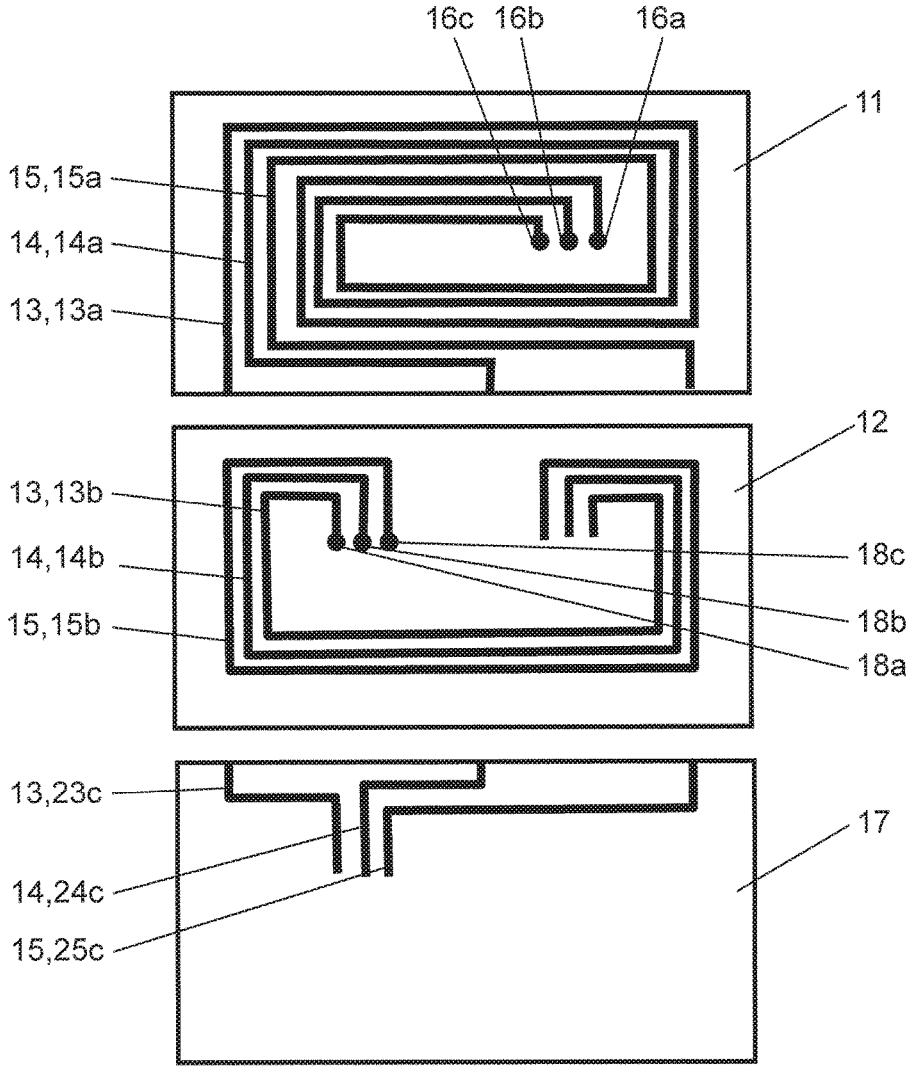
FIG. 1 is a top view of main portions of a common mode noise filter in a first exemplary embodiment.

FIG. 1 is a top view of main portions of a common mode noise filter in the first exemplary embodiment. More specifically, FIG. 1 is views of insulating layer 11, insulating layer 12, and insulating layer 17 as seen from the top, on each of which coil conductors are formed.

Insulating layer 11, insulating layer 12, and insulating layer 17 are sequentially stacked from the top. On insulating layer 11 are formed coil conductor 13*a*, coil conductor 14*a*, and coil conductor 15*a*, each of which has a spiral shape. On insulating layer 12 are formed coil conductor 13*b*, coil conductor 14*b*, and coil conductor 15*b*, each of which has a spiral shape. Coil conductor 13*a* and coil conductor 13*b* are electrically connected together to constitute coil 13. Coil conductor 14*a* and coil conductor 14*b* are electrically connected together to constitute coil 14. Coil conductor 15*a* and coil conductor 15*b* are electrically connected together to constitute coil 15. Coil 13, coil 14, and coil 15 are electrically independent of one another.

As described above, the common mode noise filter in the first exemplary embodiment includes: insulating layer 11; insulating layer 12 formed under insulating layer 11; coil 13 including coil conductor 13*a* and coil conductor 13*b* electrically connected to each other; coil 14 including coil conductor 14*a* and coil conductor 14*b* electrically connected to each other; and coil 15 including coil conductor 15*a* and coil conductor 15*b* electrically connected to each other.

Coil 13, coil 14, and coil 15 are electrically independent of one another. Coil conductor 13*a*, coil conductor 14*a*, and coil conductor 15*a* are formed side by side on insulating layer 11 in a spiral fashion such that coil conductor 13*a*, coil conductor 14*a*, and coil conductor 15*a* are sequentially positioned from the outer side. Coil conductor 13*a*, coil conductor 14*a*, and coil conductor 15*a* have regions disposed in parallel to one another.

Although coil conductor 13*a*, coil conductor 14*a*, and coil conductor 15*a* are disposed in parallel to one another, their ends do not necessarily have to be parallel to one another, as opposed to the first exemplary embodiment.

Further details of the disposition of the coil conductors will be described. The three coil conductors, more specifically, coil conductor 13*a*, coil conductor 14*a*, and coil conductor 15*a* form a single group. The group of these three coil conductors is disposed in a spiral fashion. This spiral-shaped, coil conductor group is disposed such that coil conductors 13*a*, 14*a*, 15*a* are sequentially positioned from the outer side. This configuration also applies to the other exemplary embodiments that will be described later.

Coil conductor 13*b*, coil conductor 14*b*, and coil conductor 15*b* are formed side by side on insulating layer 12 such that coil conductor 15*b*, coil conductor 14*b*, and coil conductor 13*b* are sequentially positioned from the outer side. Coil conductor 13*b*, coil conductor 14*b*, and coil conductor 15*b* have regions disposed in parallel to one another.

Although coil conductor 13*b*, coil conductor 14*b*, and coil conductor 15*b* are disposed in parallel to one another in the first exemplary embodiment, there are cases where their ends cannot be disposed in parallel to one another.

Coil conductor 13*a* and coil conductor 15*b* have regions overlapping each other as seen from the top view. Likewise, coil conductor 13*b* and coil conductor 15*a* have regions overlapping each other as seen from the top view. This means that coil conductor 13*a* does not cover the whole of coil conductor 15*b* as seen from the top view, for the sake of wiring. This configuration also applies to coil conductor 13*b* and coil conductor 15*a*.

Insulating layers 11, 12 are stacked so as to adjoin to each other. Each of insulating layers 11, 12 may be a sheet-shaped member made of a non-magnetic material or a magnetic material. Examples of the non-magnetic material include Cu—Zn ferrite and glass ceramic; examples of the magnetic material include Ni—Cu—Z ferrite. Insulating layer 12 is positioned under insulating layer 11.

Coil conductor 13*a*, coil conductor 14*a*, and coil conductor 15*a* are formed on insulating layer 11. Coil conductor 13*b*, coil conductor 14*b*, and coil conductor 15*b* are formed on insulating layer 12.

Each of coil conductors 13*a*, 14*a*, 15*a* is formed on insulating layer 11 by plating or printing a conductive material, such as silver, in spiral form having less than one turn or one or more turns. Similar to insulating layer 11, each of coil conductors 13*b*, 14*b*, 15*b* is formed on insulating layer 12 by plating or printing a conductive material, such as silver, in spiral form having less than one turn or one or more turns.

Coil 13 includes coil conductor 13*a* and coil conductor 13*b*. Coil 14 includes coil conductor 14*a* and coil conductor 14*b*. Coil 15 includes coil conductor 15*a* and coil conductor 15*b*.

Coil conductor 13*a* is electrically connected to coil conductor 13*b* through via electrode 16*a* formed in insulating layer 11. Coil conductor 14*a* is electrically connected to coil conductor 14*b* through via electrode 16*b* formed in insulating layer 11. Coil conductor 15*a* is electrically connected to coil conductor 15*b* through via electrode 16*c* formed in insulating layer 11.

As described above, the common mode noise filter in the first exemplary embodiment is provided with coil 13, coil 14, and coil 15 that are electrically independent of one another. Coil 13 is magnetically coupled to coil 14; coil 14 is magnetically coupled to coil 15; and coil 15 is magnetically coupled to coil 13.

On insulating layer 11, coil conductor 14*a* is provided on the inner side of and in substantially parallel to coil conductor 13*a* without being short-circuited to coil conductor 13*a*. Likewise, coil conductor 15*a* is provided on the inner side of and in substantially parallel to coil conductor 14*a* without being short-circuited to coil conductor 14*a*. If coil conductors 13*a*, 14*a*, 15*a* are regarded as a single group, this single group forms a spiral shape, and its spiral direction is set such that currents flow through coil conductors 13*a*, 14*a*, 15*a* in the same direction as seen from the top view.

Similar to insulating layer 11, on insulating layer 12, coil conductor 14*b* is provided on the inner side of and in substantially parallel to coil conductor 15*b* without being short-circuited to coil conductor 15*b*. Likewise, coil conductor 13*b* is provided on the inner side of and in substantially parallel to coil conductor 14*b* without being short-circuited to coil conductor 14*b*.

In short, coil conductor 13*a*, coil conductor 14*a*, and coil conductor 15*a* are sequentially disposed on insulating layer 11 from the outer side so as to be substantially parallel to one another. Likewise, coil conductor 15*b*, coil conductor 14*b*, and coil conductor 13*b* are sequentially disposed on insulating layer 12 from the outer side so as to substantially parallel to one another.

On insulating layer 11 are sequentially formed coil 13, coil 14, and coil 15 from the outer side. On insulating layer 12 are sequentially formed coil 15, coil 14, and coil 13 from the outer side.

The main portions of coil conductor 13*a* and coil conductor 15*b* overlap each other as seen from the top view. The main portions of coil conductor 15*a* and coil conductor 13*b* overlap each other as seen from the top view.

Under insulating layer 12 is formed insulating layer 17. Insulating layer 17 is provided with conductor 23*c*, as a lead, that is connected to coil conductor 13*b* through via electrode 18*a*. Insulating layer 17 is further provided with conductor 24*c*, as a lead, that is connected to coil conductor 14*b* through via electrode 18*b*. Insulating layer 17 is further provided with conductor 25*c*, as a lead, that is connected to coil conductor 15*b* through via electrode 18*c*.

Conductor 23*c* forms a portion of coil 13; conductor 24*c* forms a portion of coil 14; and conductor 25*c* forms a portion of coil 15.

As necessary, another insulating layer may be stacked on the upper or lower surface of insulating layers 11, 12, 17 to create a layered product (not illustrated). This unillustrated layered product has provided with six external electrodes (not illustrated) connected to the ends of coils 13, 14, 15, on the both end surfaces of the layered product.

Each of the other insulating layer and insulating layers 11, 12, 17 may be made of either a non-magnetic material or a magnetic material.

In the common mode noise filter in the first exemplary embodiment of the present disclosure, as described above, coil conductor 14*a* and coil conductor 13*a* are disposed adjacent to and in substantially parallel to each other in the same plane. In addition, coil conductor 14*b* and coil conductor 13*b* are disposed adjacent to and in substantially parallel to each other in the same plane. This means that coil 14 is disposed adjacent to coil 13 at the two locations.

Likewise, coil conductor 14*a* and coil conductor 15*a* are disposed adjacent to and in substantially parallel to each other in the same plane. In addition, coil conductor 14*b* and coil conductor 15*b* are disposed adjacent to and in substantially parallel to each other in the same plane. This means that coil 14 is also disposed adjacent to coil 15 at the two locations.

The portions of coil conductor 13*a* and coil conductor 15*a* which correspond to the same ordinal numbers of turns of the spiral form are not disposed adjacent to each other in the same plane. Likewise, the portions of coil conductor 13*b* and coil conductor 15*b* which correspond to the same ordinal numbers of turns of the spiral form are not disposed adjacent to each other in the same plane. However, coil conductor 13*a* overlaps coil conductor 15*b* as seen from a top view. Likewise, coil conductor 15*a* overlaps coil conductor 13*b* as seen from a top view. This means that coil 13 overlaps coil 15 at the two locations as seen from the top view.

Consequently, in the common mode noise filter in the first exemplary embodiment, the magnetic couplings of the three coils are balanced.

More specifically, coil 13 is disposed adjacent to coil 14 on insulating layer 11 at one location and on insulating layer 12 at one location, namely, at the two locations in total. Likewise, coil 14 is disposed adjacent to coil 15 on insulating layer 11 at one location and on insulating layer 12 at one location, namely, at the two locations in total. Moreover, the portions of coil 13 and coil 15 which correspond to the same ordinal numbers of turns of the spiral form with respect to the direction from the outer circumference to the inner circumference of coil 13 are not disposed adjacent to each other in the identical planes on either insulating layer 11 or insulating layer 12. However, coil 13 faces coil 15 and thus is disposed adjacent to coil 15 at one location between coil conductor 13*a* and coil conductor 15*b* and at one location between coil conductor 15*a* and coil conductor 13*b*, namely, at the two locations in total. Therefore, the number of locations adjacent to one other between the three coils is the same, so that their magnetic couplings exhibit substantially the same strength.

In the above description, it should be noted that, of the portions of the coils disposed adjacent to each other in the same insulating layer, only the portions corresponding to the same ordinal numbers of turns of the spiral form with respect to the direction from the outer circumference to the inner circumference are counted as the number of locations adjacent to one other between the coils. If different winding numbers of coils are used, their phases greatly differ from each other, because the distances between the electrodes and the coil conductors greatly differ from one another. A magnetic coupling between coils having different phases is not so strong. For this reason, their adjacent locations are not counted as adjacent locations of coils. For example, although on insulating layer 11, the portion of coil conductor 15*a* corresponding to the first turn of the spiral form with respect to the direction from the outer side is adjacent to the portion of coil conductor 13*a* corresponding to the second turn with respect to the direction from the outer side, these portions are not counted as the number of locations adjacent to one other between the coils.

It is preferable that the distances between coil conductor 13*a* and coil conductor 15*b*, between coil conductor 15*a* and coil conductor 13*b*, between coil conductor 13*a* and coil conductor 14*a*, between coil conductor 14*a* and coil conductor 15*a*, between coil conductor 13*b* and coil conductor 14*b*, and between coil conductor 14*b* and coil conductor 15*b* be substantially the same as one another.

Modification of First Exemplary Embodiment

Figure 2:
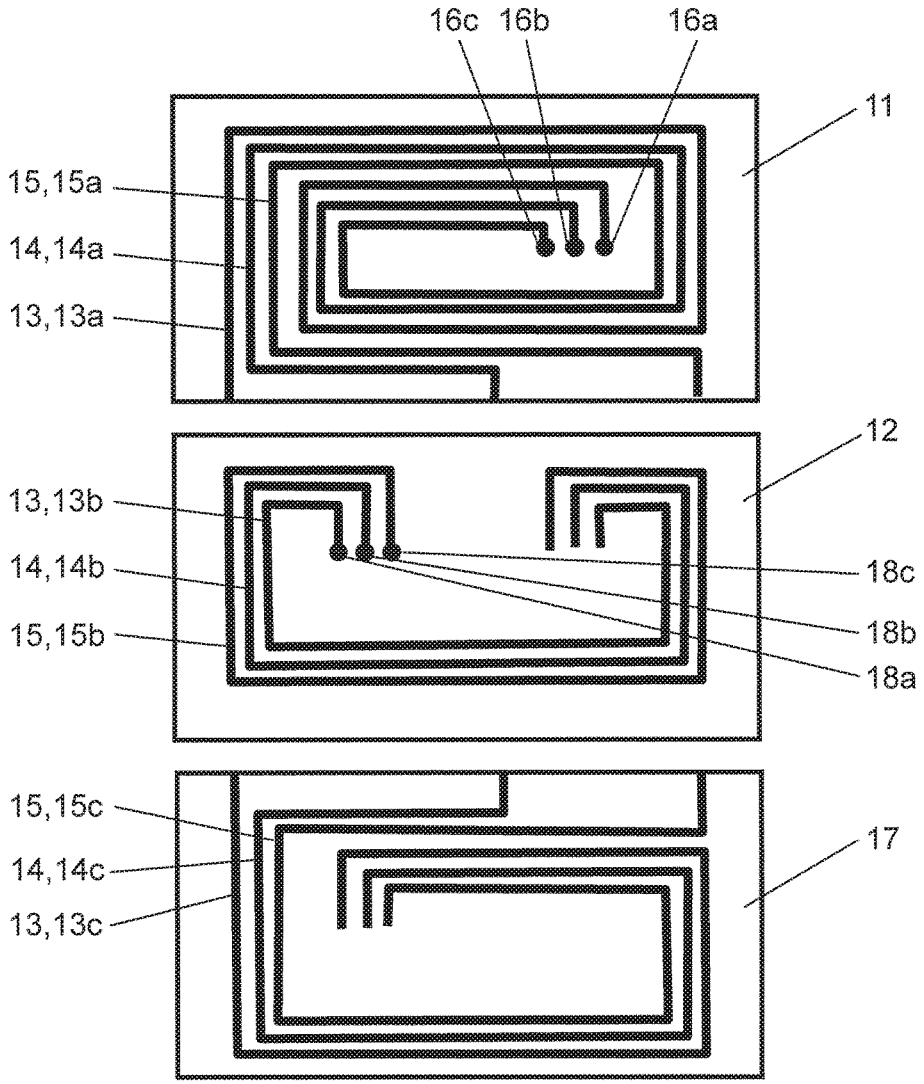
FIG. 2 is a top view of main portions of a common mode noise filter in a modification of the first exemplary embodiment.

Next, a modification of the first exemplary embodiment will be described with reference to FIG. 2. FIG. 2 is a top view of main portions of a common mode noise filter in the modification of the first exemplary embodiment. Components in the modification which are the same as components in the foregoing first exemplary embodiment are given identical reference numerals and will not be described.

In the first exemplary embodiment of FIG. 1, conductors 23*c*, 24*c*, 25*c* are formed on insulating layer 17 as leads. However, in the modification of the first exemplary embodiment of FIG. 2, coil conductors 13*c*, 14*c*, 15*c* formed on insulating layer 17 each have a spiral shape.

Coil conductor 13*c*, coil conductor 14*c*, and coil conductor 15*c* are sequentially formed on insulating layer 17 from the outer side. In this case, coil conductor 13*c* forms coil 13; coil conductor 14*c* forms coil 14; and coil conductor 15*c* forms coil 15. Furthermore, coil conductor 13*c*, coil conductor 14*c*, and coil conductor 15*c* are disposed in substantially parallel to one another. In this modification, the ends of coil conductor 13*c*, coil conductor 14*c*, and coil conductor 15*c* are not disposed in parallel to one another. The wholes of coil conductor 13*c*, coil conductor 14*c*, and coil conductor 15*c* are not necessarily disposed in parallel to one another. This configuration also applies to the exemplary embodiment and its modification that will be described later.

The common mode noise filter in this modification includes: insulating layer 17 formed under insulating layer 12; coil conductor 13*c*, which forms coil 13; coil conductor 14*c*, which forms coil 14; and coil conductor 15*c*, which forms coil 15. Coil conductor 13*c*, coil conductor 14*c*, and coil conductor 15*c* are formed side by side on insulating layer 17 in a spiral fashion such that coil conductor 13*c*, coil conductor 14*c*, and coil conductor 15*c* are sequentially positioned from the outer side. Coil conductor 13*c*, coil conductor 14*c*, and coil conductor 15*c* have regions disposed in parallel to one another.

In this modification, coil conductor 13*c* overlaps coil conductor 15*b* as seen from the top view. Coil conductor 15*c* overlaps coil conductor 13*b* as seen from the top view.

Although coil conductor 13*c*, coil conductor 14*c*, and coil conductor 15*c* are disposed in parallel to one another in this modification, there are cases where their ends cannot be disposed in parallel to one another.

Coil conductor 13*b* and coil conductor 15*c* have regions overlapping each other as seen from the top view. Coil conductor 13*c* and coil conductor 15*b* have regions overlapping each other as seen from the top view. In other words, coil conductor 13*b* and coil conductor 15*c* have portions that do not overlap each other as seen from the top view, for the sake of wiring. This configuration also applies to coil conductor 13*c* and coil conductor 15*b*.

In this modification, on insulating layer 11 are sequentially disposed coil 13, coil 14, and coil 15 from the outer side. On insulating layer 12 are sequentially disposed coil 15, coil 14, and coil 13 from the outer side. On insulating layer 17 are sequentially disposed coil 13, coil 14, and coil 15 from the outer side.

In the modification of the first exemplary embodiment which has been described with reference to FIG. 2, the magnetic couplings of the three coils have substantially the same strength.

Second Exemplary Embodiment

Next, a second exemplary embodiment will be described with reference to FIG. 3.

Figure 3:
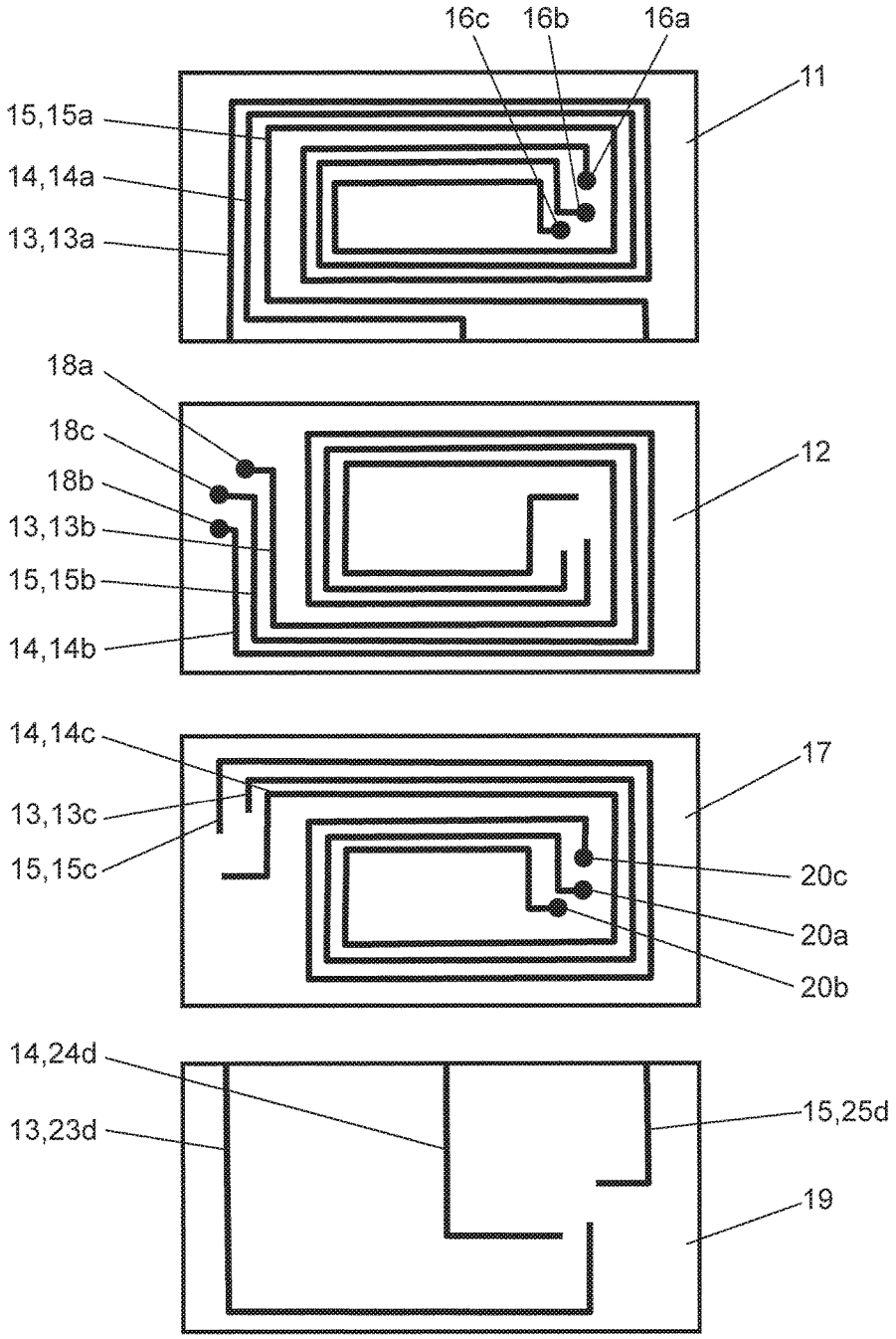
FIG. 3 is a top view of main portions of a common mode noise filter in a second exemplary embodiment.

FIG. 3 is a top view of main portions of a common mode noise filter in the second exemplary embodiment of the present disclosure. Components in the second exemplary embodiment of the present invention which are the same as components in the foregoing first exemplary embodiment of the present disclosure are given identical reference numerals and will not be described.

As illustrated in FIG. 3, on insulating layer 12 are disposed coil conductor 13*b*, coil conductor 14*b*, and coil conductor 15*b* in substantially parallel to one another such that coil conductor 14*b*, coil conductor 15*b*, and coil conductor 13*b* are sequentially positioned from the outer side. In this case, coil conductor 13*b* forms coil 13; coil conductor 14*b* forms coil 14; and coil conductor 15*b* forms coil 15. The manner in which coil conductors 13*a*, 14*a*, 15*a* are disposed on insulating layer 11 is the same as the manner in the first exemplary embodiment.

On insulating layer 17 are disposed coil conductor 13*c*, coil conductor 14*c*, and coil conductor 15*c* in a spiral fashion and in substantially parallel to one another such that coil conductor 15*c*, coil conductor 13*c*, and coil conductor 14*c* are sequentially positioned from the outer side. In this case, coil conductor 13*c* forms coil 13; coil conductor 14*c* forms coil 14; and coil conductor 15*c* forms coil 15. Furthermore, coil conductor 13*a*, coil conductor 14*b*, and coil conductor 15*c* overlap one another as seen from the top view. Likewise, coil conductor 14*a*, coil conductor 15*b*, and coil conductor 13*c* overlap one another as seen from the top view. Coil conductor 15*a*, coil conductor 13*b*, and coil conductor 14*c* overlap one another as seen from the top view.

It should be noted that all of the coil conductors do not overlap one another, similar to the first exemplary embodiment.

As described above, the common mode noise filter in the first exemplary embodiment includes: insulating layer 11; insulating layer 12 formed under insulating layer 11; coil 13 including coil conductor 13*a* and coil conductor 13*b* electrically connected to each other; coil 14 including coil conductor 14*a* and coil conductor 14*b* electrically connected to each other; and coil 15 including coil conductor 15*a* and coil conductor 15*b* electrically connected to each other.

Coil 13, coil 14, and coil 15 are electrically independent of one another. Coil conductor 13*a*, coil conductor 14*a*, and coil conductor 15*a* are formed side by side on insulating layer 11 in a spiral fashion such that coil conductor 13*a*, coil conductor 14*a*, and coil conductor 15*a* are sequentially positioned from the outer side. Coil conductor 13*a*, coil conductor 14*a*, and coil conductor 15*a* have regions disposed in parallel to one another.

Coil conductor 13*b*, coil conductor 14*b*, and coil conductor 15*b* are formed side by side on insulating layer 12 in a spiral fashion such that coil conductor 14*b*, coil conductor 15*b*, and coil conductor 13*b* are sequentially positioned from the outer side. Coil conductor 13*b*, coil conductor 14*b*, and coil conductor 15*b* have regions disposed in parallel to one another.

Coil conductor 13*a* and coil conductor 14*b* have regions overlapping each other as seen from the top view. Coil conductor 14*a* and coil conductor 15*b* have regions overlapping each other as seen from the top view. Coil conductor 15*a* and coil conductor 13*b* have regions overlapping each other as seen from the top view.

Coil conductor 13*a* and coil conductor 14*b* have portions that do not overlap each other as seen from the top view, for the sake of wiring, similar to the first exemplary embodiment. This configuration applies to coil conductor 14*a* and coil conductor 15*b* and also applies to coil conductor 15*a* and coil conductor 13*b*.

Insulating layer 19 is formed under insulating layer 17. Insulating layer 19 is provided with conductor 23*d*, as a lead, that is connected to coil conductor 13*c* through via electrode 20*a*. Insulating layer 19 is further provided with conductor 24*d*, as a lead, that is connected to coil conductor 14*c* through via electrode 20*b*. Insulating layer 19 is further provided with conductor 25*d*, as a lead, that is connected to coil conductor 15*c* through via electrode 20*c*.

Conductor 23*d* forms a portion of coil 13; conductor 24*d* forms a portion of coil 14; and conductor 25*d* forms a portion of coil 15.

On insulating layer 11 are disposed coil 13, coil 14, and coil 15 such that coil 13, coil 14, and coil 15 are sequentially positioned from the outer side. On insulating layer 12 are disposed coil 13, coil 14, and coil 15 such that coil 14, coil 15, and coil 13 are sequentially positioned from the outer side. On insulating layer 17 are disposed coil 13, coil 14, and coil 15 such that coil 15, coil 13, and coil 14 are sequentially positioned from the outer side.

Coil 13 is disposed adjacent to coil 14 on insulating layer 11 at one location and on insulating layer 17 at one location, as well as at the location where coil conductor 13*a* faces coil conductor 14*b* and at the location where coil conductor 13*b* faces coil conductor 14*c*. In other words, coil 13 is disposed adjacent to coil 14 at the four locations in total.

In the above description, it should be noted that, of the portions of the coils disposed adjacent to each other on the same insulating layer, only the portions corresponding to the same ordinal numbers of turns of the spiral form with respect to the direction from the outer circumference to the inner circumference are counted as the number of locations adjacent to one other between the coils, similar to the first exemplary embodiment.

Likewise, coil 14 is disposed adjacent to coil 15 at four locations, and coil 13 is disposed adjacent to coil 15 at four locations. Thus, the number of locations adjacent to one other between the three coils is the same. As a result, the magnetic couplings of the coils exhibit substantially the same strength.

It should be noted that coil conductor 15*c*, coil conductor 14*c*, and coil conductor 13*c* do not necessarily have to be formed on insulating layer 17. Even if coil conductor 15*c*, coil conductor 14*c*, and coil conductor 13*c* are not formed, the number of the locations adjacent to each other between coil 13 and coil 14, the number of the locations adjacent to each other between coil 14 and coil 15, the number of the locations adjacent to each other between coil 15 and coil 13 are the same. As a result, the magnetic couplings of the coils exhibit substantially the same strength.

The common mode noise filter in the second exemplary embodiment includes: insulating layer 17 formed under insulating layer 12; coil conductor 13*c*, which forms coil 13; coil conductor 14*c*, which forms coil 14; and coil conductor 15*c*, which forms coil 15.

Coil conductor 13*c*, coil conductor 14*c*, and coil conductor 15*c* are formed side by side on insulating layer 17 in a spiral fashion such that coil conductor 15*c*, coil conductor 13*c*, and coil conductor 14*c* are sequentially positioned from the outer side. Coil conductor 13*c*, coil conductor 14*c*, and coil conductor 15*c* have regions disposed in parallel to one another.

Coil conductor 13*b* and coil conductor 14*c* have regions overlapping each other as seen from the top view. Coil conductor 14*b* and coil conductor 15*c* have regions overlapping each other as seen from the top view. Coil conductor 15*b* and coil conductor 13*c* have regions overlapping each other as seen from the top view.

Coil conductor 13*b* and coil conductor 14*c* have portions that do not overlap each other as seen from the top view, for the sake of wiring, similar to the modification of the first exemplary embodiment. This configuration applies to coil conductor 14*b* and coil conductor 15*c* and also applies to coil conductor 15*b* and coil conductor 13*c*.

Modification of Second Exemplary Embodiment

Figure 4:
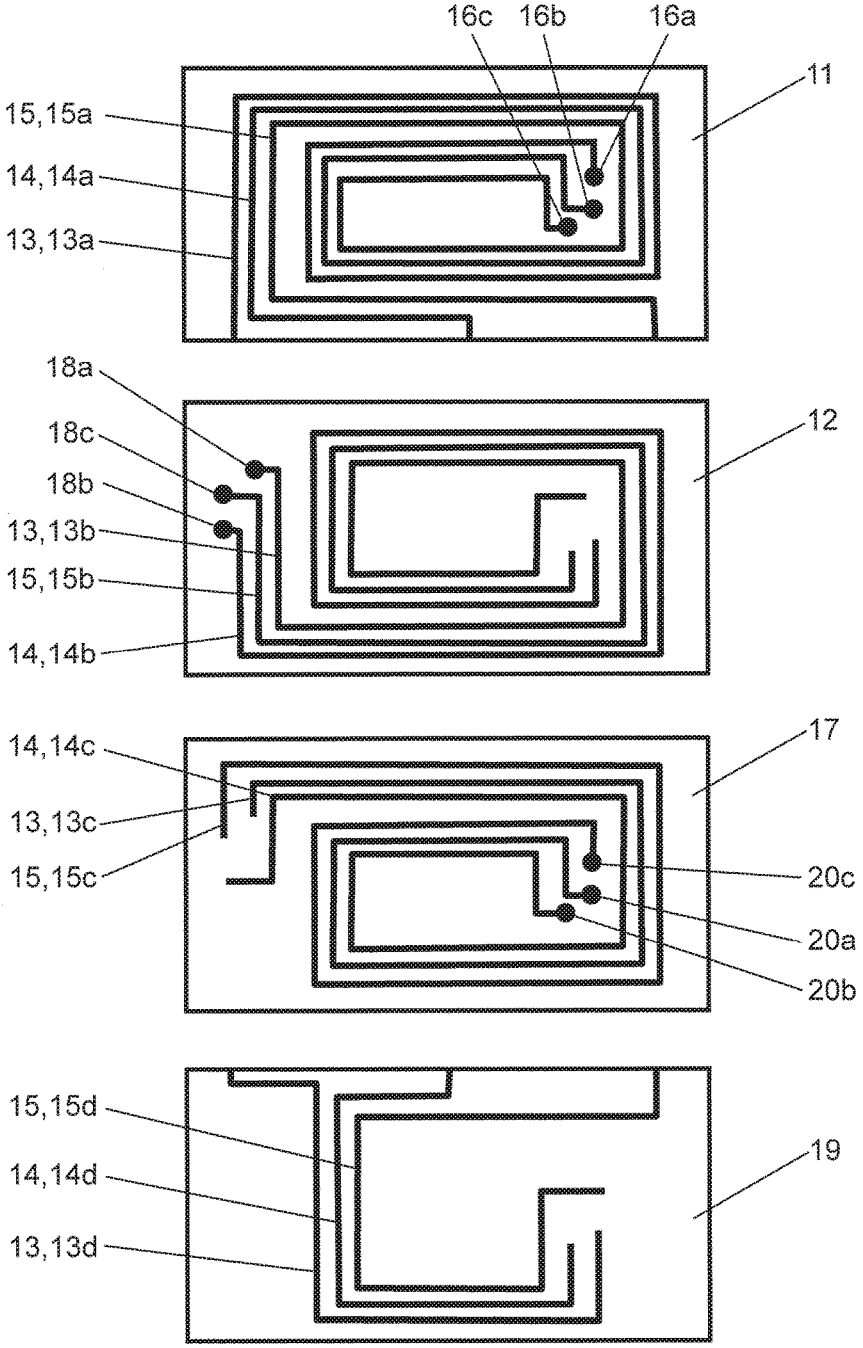
FIG. 4 is a top view of main portions of a common mode noise filter in a modification of the second exemplary embodiment.

Next, a modification of the second exemplary embodiment will be described with reference to FIG. 4. FIG. 4 is a top view of main portions of a common mode noise filter in a modification of a second exemplary embodiment. Components in the modification which are the same as components in the foregoing second exemplary embodiment are given identical reference numerals and will not be described.

In the second exemplary embodiment that has been described with reference to FIG. 3, conductors 23*d*, 24*d*, 25*d* are formed on insulating layer 19, as leads. In contrast, in the modification of the second exemplary embodiment, coil conductors 13*d*, 14*d*, 15*d* each of which has a spiral shape are formed on insulating layer 19 instead of conductors 23*d*, 24*d*, 25*d* as leads, as illustrated in FIG. 4. The coil conductor 13*d* forms coil 13; the coil conductor 14*d* forms coil 14; and the coil conductor 15*d* forms coil 15. In short, coil conductor 13*d*, coil conductor 14*d*, and coil conductor 15*d* are sequentially disposed on insulating layer 19 from the outer side so as to be substantially parallel to one another. Coil conductor 13*d* overlaps coil conductor 15*c* as seen from the top view. Coil conductor 14*d* overlaps coil conductor 13*c* as seen from the top view. Coil conductor 15*d* overlaps coil conductor 14*c* as seen from the top view.

The common mode noise filter in this exemplary embodiment includes: insulating layer 19 formed under insulating layer 17; coil conductor 13*d*, which forms coil 13; coil conductor 14*d*, which forms coil 14; and coil conductor 15*d*, which forms coil 15.

Coil conductor 13*d*, coil conductor 14*d*, and coil conductor 15*d* are formed side by side on insulating layer 19 in a spiral fashion such that coil conductor 13*d*, coil conductor 14*d*, and coil conductor 15*d* are sequentially positioned from the outer side. Coil conductor 13*d*, coil conductor 14*d*, and coil conductor 15*d* have regions disposed in parallel to one another.

Coil conductor 13*c* and coil conductor 14*d* have regions overlapping each other as seen from the top view. Coil conductor 14*c* and coil conductor 15*d* have regions overlapping each other as seen from the top view. Coil conductor 15*c* and coil conductor 13*d* have regions overlapping each other as seen from the top view.

Coil conductor 13*c* and coil conductor 14*d* have portions that do not overlap each other as seen from the top view, for the sake of wiring, similar to the other exemplary embodiments. This configuration applies to coil conductor 14*c* and coil conductor 15*d* and also applies to coil conductor 15*c* and coil conductor 13*d*.

According to the above configuration of the common mode noise filter in this modification, the coil conductors are formed in the following way. Coil 13, coil 14, and coil 15 are sequentially formed on insulating layer 11 from the outer side. Coil 14, coil 15, and coil 13 are sequentially formed on insulating layer 12 from the outer side. Coil 15, coil 13, and coil 14 are sequentially formed on insulating layer 17 from the outer side. Coil 13, coil 14, and coil 15 are formed on insulating layer 19 from the outer side.

In this modification, the magnetic couplings of the three coils have substantially the same strength, similar to the second exemplary embodiment.

In the above exemplary embodiments, it should be noted that the terms associated with a position, such as "over" and "under", are intended to indicate relative positional relationships and thus do not indicate absolute positional relationships.

INDUSTRIAL APPLICABILITY

The common mode noise filter according to the present disclosure includes three coils that can be magnetically coupled to one another in a balanced manner. Thus, the present disclosure is applicable to compact, slim common mode noise filters, especially for use in a digital device, an audiovisual device, and an information communication terminal, and other electrical devices.

REFERENCE MARKS IN THE DRAWINGS

1, 11, 12, 17, 19 insulating layer
2, 3, 4, 13, 14, 15 coil
2*a*, 2*b*, 3*a*, 3*b*, 4*a*, 4*b*, 13*a*, 13*b*, 13*c*, 13*d*, 14*a*, 14*b*, 14*c*, 14*d*, 15*a*, 15*b*, 15*c*, 15*d* coil conductor
23*c*, 24*c*, 25*c*, 23*d*, 24*d*, 25*d* conductor

The invention claimed is:

1. A common mode noise filter comprising:
a first insulating layer;
a second insulating layer formed under the first insulating layer;
a first coil including a first coil conductor and a second coil conductor, the first coil conductor being electrically connected to the second coil conductor;
a second coil including a third coil conductor and a fourth coil conductor, the third coil conductor being electrically connected to the fourth coil conductor; and
a third coil including a fifth coil conductor and a sixth coil conductor, the fifth coil conductor being electrically connected to the sixth coil conductor,
wherein the first coil, the second coil, and the third coil are electrically independent of one another,
the first coil conductor, the third coil conductor, and the fifth coil conductor are formed side by side on the first insulating layer in a spiral fashion such that the first coil conductor, the third coil conductor, and the fifth coil conductor are sequentially positioned from an outer side of the first insulating layer,
the first coil conductor, the third coil conductor, and the fifth coil conductor have regions disposed in parallel to one another,
the second coil conductor, the fourth coil conductor, and the sixth coil conductor are formed side by side on the second insulating layer such that the fourth coil conductor, the sixth coil conductor, and the second coil conductor are sequentially positioned from an outer side of the second insulating layer,
the second coil conductor, the fourth coil conductor, and the sixth coil conductor have regions disposed in parallel to one another,
the first coil conductor and the fourth coil conductor have regions overlapping each other as seen from a top view,
the third coil conductor and the sixth coil conductor have regions overlapping each other as seen from a top view, and
the fifth coil conductor and the second coil conductor have regions overlapping each other as seen from a top view.

2. The common mode noise filter according to claim 1, further comprising:
a third insulating layer formed under the second insulating layer;
a seventh coil conductor that forms the first coil;
an eighth coil conductor that forms the second coil; and
a ninth coil conductor that forms the third coil,
wherein the seventh coil conductor, the eighth coil conductor, and the ninth coil conductor are formed side by side on the third insulating layer in a spiral fashion such that the ninth coil conductor, the seventh coil conductor, and the eighth coil conductor are sequentially positioned from an outer side of the third insulating layer, and
the seventh coil conductor, the eighth coil conductor, and the ninth coil conductor have regions disposed in parallel to one another.

3. The common mode noise filter according to claim 2, wherein
the second coil conductor and the eighth coil conductor have regions overlapping each other as seen from a top view,
the fourth coil conductor and the ninth coil conductor have regions overlapping each other as seen from a top view, and
the sixth coil conductor and the seventh coil conductor have regions overlapping each other as seen from a top view.

4. The common mode noise filter according to claim 3, further comprising:
a fourth insulating layer formed under the third insulating layer;
a tenth coil conductor that forms the first coil;
an eleventh coil conductor that forms the second coil; and
a twelfth coil conductor that forms the third coil,
wherein the tenth coil conductor, the eleventh coil conductor, and the twelfth coil conductor are formed side by side on the fourth insulating layer in a spiral fashion such that the tenth coil conductor, the eleventh coil conductor, and the twelfth coil conductor are sequentially positioned from an outer side of the fourth insulating layer, and
the tenth coil conductor, the eleventh coil conductor, and the twelfth coil conductor have regions disposed in parallel to one another.

5. The common mode noise filter according to claim 4, wherein
the seventh coil conductor and the eleventh coil conductor have regions overlapping each other as seen from a top view,
the eighth coil conductor and the twelfth coil conductor have regions overlapping each other as seen from a top view, and
the ninth coil conductor and the tenth coil conductor have regions overlapping each other as seen from a top view.

* * * * *